US011834230B2

(12) United States Patent
Angelozzi et al.

(10) Patent No.: US 11,834,230 B2
(45) Date of Patent: Dec. 5, 2023

(54) TAMPER EVIDENT OVERCAP FOR DRUMS

(71) Applicant: RIEKE LLC, Auburn, IN (US)

(72) Inventors: Anthony Angelozzi, Fort Wayne, IN (US); Dale Taylor, Hamilton, IN (US)

(73) Assignee: RIEKE LLC, Auburn, IN (US)

( * ) Notice: Subject to any disclaimer, the term of this patent is extended or adjusted under 35 U.S.C. 154(b) by 247 days.

(21) Appl. No.: 17/295,475

(22) PCT Filed: Nov. 20, 2019

(86) PCT No.: PCT/US2019/062340
§ 371 (c)(1),
(2) Date: May 20, 2021

(87) PCT Pub. No.: WO2020/106801
PCT Pub. Date: May 28, 2020

(65) Prior Publication Data

US 2021/0387771 A1 Dec. 16, 2021

Related U.S. Application Data

(60) Provisional application No. 62/769,728, filed on Nov. 20, 2018.

(51) Int. Cl.
*B65D 41/48* (2006.01)
*B65D 51/20* (2006.01)
(Continued)

(52) U.S. Cl.
CPC ..... *B65D 41/48* (2013.01); *B65D 51/18* (2013.01); *B65D 51/20* (2013.01);
(Continued)

(58) Field of Classification Search
CPC ..... B65D 41/48; B65D 51/20; B65D 2251/0015; B65D 2251/205; B65D 2401/25; B65D 51/18
(Continued)

(56) References Cited

U.S. PATENT DOCUMENTS 3,707,240 A * 12/1972 Wilson ..... B65D 41/485 215/901
4,322,010 A 3/1982 Curry
(Continued)

FOREIGN PATENT DOCUMENTS

CN 1231257 A 10/1999
WO 2016169934 10/2016

OTHER PUBLICATIONS

Supplementary European Search Report for Application 19886854, PCT/US2019/062340, dated Jul. 1, 2022, 8 pgs., European Patent Office, Germany.
(Continued)

*Primary Examiner* — James N Smalley
(74) *Attorney, Agent, or Firm* — McDonald Hopkins LLC

(57) ABSTRACT

A snap fitting, tamper evident overcap for drums and bung covers is described. The tamper evident strip is attached to a peripheral edge of the overcap, and it is removed by tearing along a vertical groove formed in the strip and then, by way of a grasping handle, rotationally pulling the strip so as to break the frangible bridge elements that previously held the strip to the overcap.

14 Claims, 3 Drawing Sheets

(51) Int. Cl.
*B65D 51/08* (2006.01)
*B65D 51/18* (2006.01)

(52) U.S. Cl.
CPC ..... *B65D 2251/0015* (2013.01); *B65D 2251/205* (2013.01); *B65D 2401/25* (2020.05)

(58) Field of Classification Search
USPC ..... 215/317, 320, 321; 220/780
See application file for complete search history.

(56) References Cited

U.S. PATENT DOCUMENTS 4,387,818 A * 6/1983 Conti ..... B65D 41/485 215/901
4,534,481 A 8/1985 Summers
4,678,094 A 7/1987 Bullock
4,732,293 A * 3/1988 Landis ..... B65D 43/0258 215/256
5,560,504 A * 10/1996 Molinaro ..... B65D 41/3404 215/256
5,996,833 A 12/1999 Encioni
6,260,721 B1 7/2001 Ohmi et al.
6,360,908 B1 3/2002 Kline
7,080,749 B2 7/2006 Van Bruggen
7,537,132 B2 5/2009 Marple
7,568,585 B2 * 8/2009 Baughman ..... B65D 51/18 220/780
8,118,187 B2 * 2/2012 D'Amato ..... B65D 43/0212 220/780
D800,276 S 10/2017 Taylor et al.
2005/0121451 A1 * 6/2005 Van Bruggen ..... B65D 41/62 220/257.2
2006/0102583 A1 5/2006 Baughman et al.
2016/0052679 A1 2/2016 Rudy

OTHER PUBLICATIONS

International Search Report and Written Opinion dated Jan. 15, 2020; International Patent Application No. PCT/US2019/062340 filed on Nov. 20, 2019. ISA/US.
"Metal Tab-Seal® Caps," Tri-Sure Company, date unknown.
"Samba-CapTM Caps," Tri-Sure Company, date unknown.

* cited by examiner

TAMPER EVIDENT OVERCAP FOR DRUMS

CROSS REFERENCE TO RELATED APPLICATIONS

This patent application is a 35 U.S.C. § 371 national stage application of PCT Application No. PCT/US2019/062340 filed on Nov. 20, 2019, entitled "TAMPER EVIDENT OVERCAP FOR DRUMS," which claims priority to U.S. Provisional Patent Application Ser. No. 62/769,728 filed on Nov. 20, 2018, each of which are incorporated by reference herein in their entireties.

TECHNICAL FIELD

The present invention relates to a tamper evident cap for sealing drums with a circular interface between the plug and the bung hole and, more specifically, a cap having a frangible tear strip concentrically disposed around a cap with an inwardly disposed, ramped, circumferential flange.

BACKGROUND

U.S. Pat. Nos. 4,534,481; 5,996,833; 6,360,908; 7,080,749; 7,537,132; and 7,568,585 provide examples of tamper-evident (TE) tear strips provided to caps for steel drums. Generally speaking, these designs disclose tamper evident features that employ single-use, frangible elements fitted over the closure of a drum bunghole. In some prior art designs, tear strips, defined by thinned or perforated lines scored into that sidewall. are formed in the sidewalls of the cap. Others contemplate a frangible "bridge" elements allowing for detachment of an annular strip which encircles the cap. Still others provide for one or multiple foldable or removable sections to be formed in top panel, with the foldable/removable sections urged out of place by a pull ring or tab or even removable sections of sidewall and/or the detached, annular strip itself. The removal or folding of certain elements provides evidence of opening/use.

One disadvantage to these prior designs are that the hidden and/or interconnected nature of the removable elements may not be immediately apparent to a user. That is, when scored or perforated sections are not immediately recognizable, the user may not understand where force must be applied to remove (or fold) these sections. Also, designs relying on the cap itself forming part of the TE feature within the top panel eviscerate the further utility of the cap itself (e.g., the cap is necessarily torn or displaced, so as to prevent its continued reuse on the now-opened drum, thereby leaving the underlying cover exposed to the elements). Lastly, to the extent a TE, removable, annular strip is provided proximate to as part of the sidewall, these strips may not provide sufficient structural protection to the sides of the cap (potentially allowing the cap and/or the strip to become inadvertently dislodged).

An overcap having tamper-evident features that is easy to remove but that retains its utility to fit over the underlying bunghole cover is needed. In the same manner, a TE overcap that is low cost and relatively easier to manufacture would be welcome.

All of the aforementioned patent documents are incorporated by reference as additional context for common materials and methods inherent to formation of frangible elements and tear strips. Thus, in view of the foregoing disclosure, certain aspects of the invention may be supplemented by reference to the features found in these conventional designs.

SUMMARY

An overcap for closure is contemplated. The overcap selectively engages a bunghole cover that may be affixed to the circular opening of an aperture formed in a drum. The overcap is made from a polymeric and/or easily formed (e.g., injection or other molding) material. A frangible ring is affixed in a concentric position around the cap itself. An inwardly disposed flange is provided on the inner skirt of the cap so as to break the frangible elements holding the ring to the cap when the cap if the cap is removed (by action of the snap-fitting, retention flange being displaced outwardly as it slide over the lip of the bunghole on the drum itself). Alternatively, the ring may be deliberately removed by a user who grasps a handle element and pulls radially outward and then upward to detach the ring as a single, disposable strip. In either case, the cap remains intact and can be reused.

Specific reference is made to the appended claims, drawings, and description below, all of which disclose elements of the invention. While specific embodiments are identified, it will be understood that elements from one described aspect may be combined with those from a separately identified aspect. In the same manner, a person of ordinary skill will have the requisite understanding of common processes, components, and methods, and this description is intended to encompass and disclose such common aspects even if they are not expressly identified herein.

DESCRIPTION OF THE DRAWINGS

Operation of the invention may be better understood by reference to the detailed description taken in connection with the following illustrations. These appended drawings form part of this specification, and any information on/in the drawings is both literally encompassed (i.e., the actual stated values) and relatively encompassed (e.g., ratios for respective dimensions of parts). In the same manner, the relative positioning and relationship of the components as shown in these drawings, as well as their function, shape, dimensions, and appearance, may all further inform certain aspects of the invention as if fully rewritten herein. Unless otherwise stated, all dimensions in the drawings are with reference to inches, and any printed information on/in the drawings form part of this written disclosure.

In the drawings and attachments, all of which are incorporated as part of this disclosure.

DETAILED DESCRIPTION

Reference will now be made in detail to exemplary embodiments of the present invention, examples of which are illustrated in the accompanying drawings. It is to be understood that other embodiments may be utilized and structural and functional changes may be made without departing from the respective scope of the invention. As such, the following description is presented by way of illustration only and should not limit in any way the various alternatives and modifications that may be made to the illustrated embodiments and still be within the spirit and scope of the invention.

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

The descriptions and drawings in this disclosure, and any written matter within the drawings should be deemed to be reproduced as part of this specification.

Figure 1:
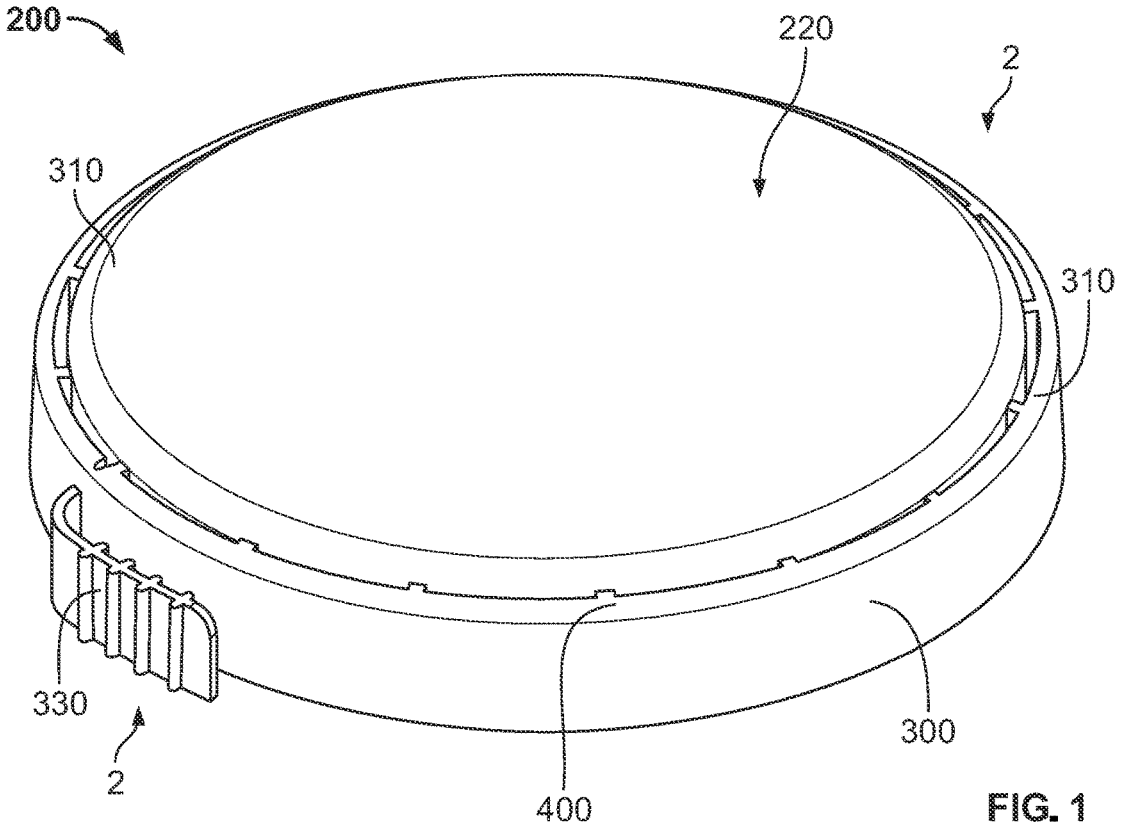
FIG. 1 is a top perspective view of one aspect of the overcap and TE ring.
Figure 2:
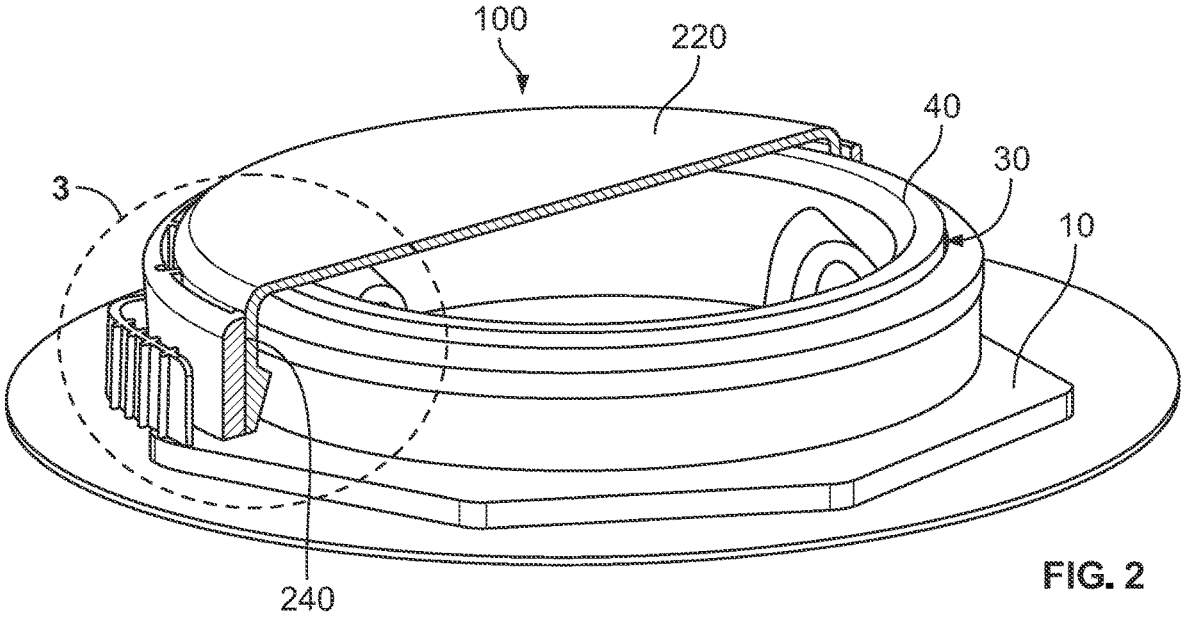
FIG. 2 is a top perspective view a one-half cross sectioned overcap and TE ring, taken along line 2-2 in FIG. 1, as installed over the bung cover and aperture on a drum.
Figure 3:
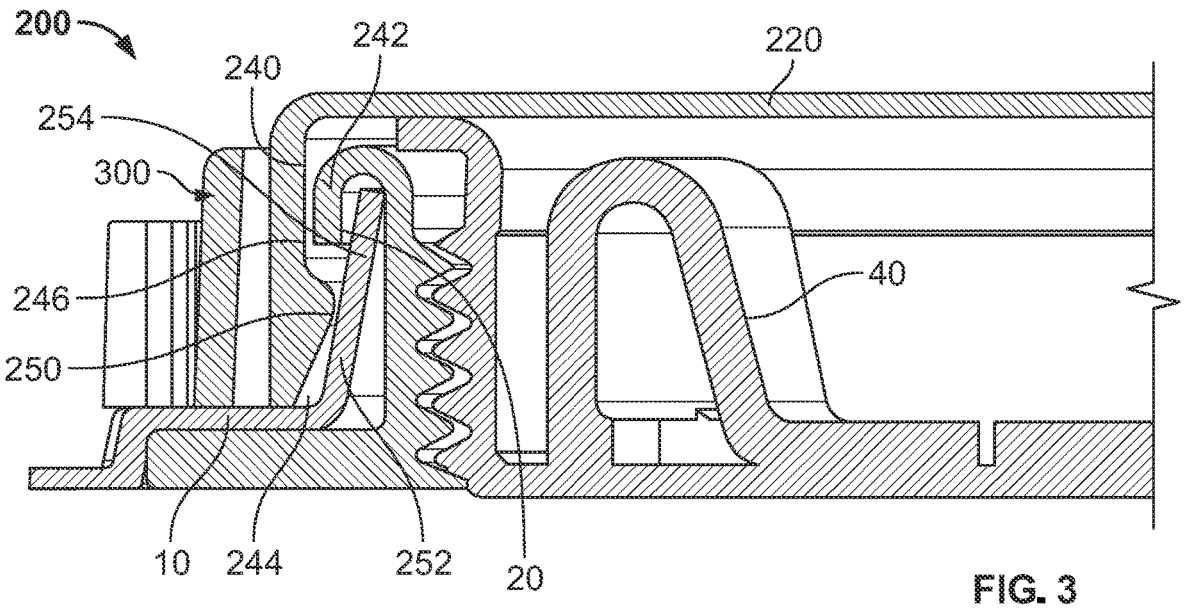
FIG. 3 is a sectional side view of the one-half cross sectioned overcap, TE ring, bung cover, and drum, as indicated by callout 3 in FIG. 2.
Figure 4:
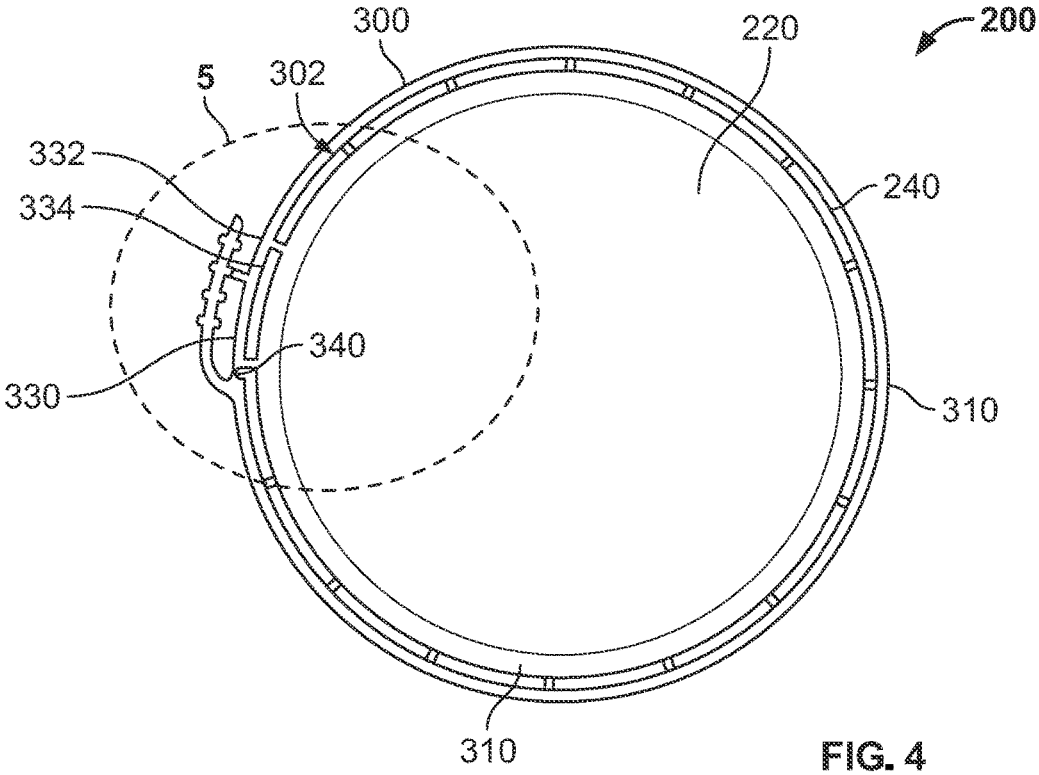
FIG. 4 is bottom plan view of the overcap and TE ring of FIG. 1.
Figure 5:
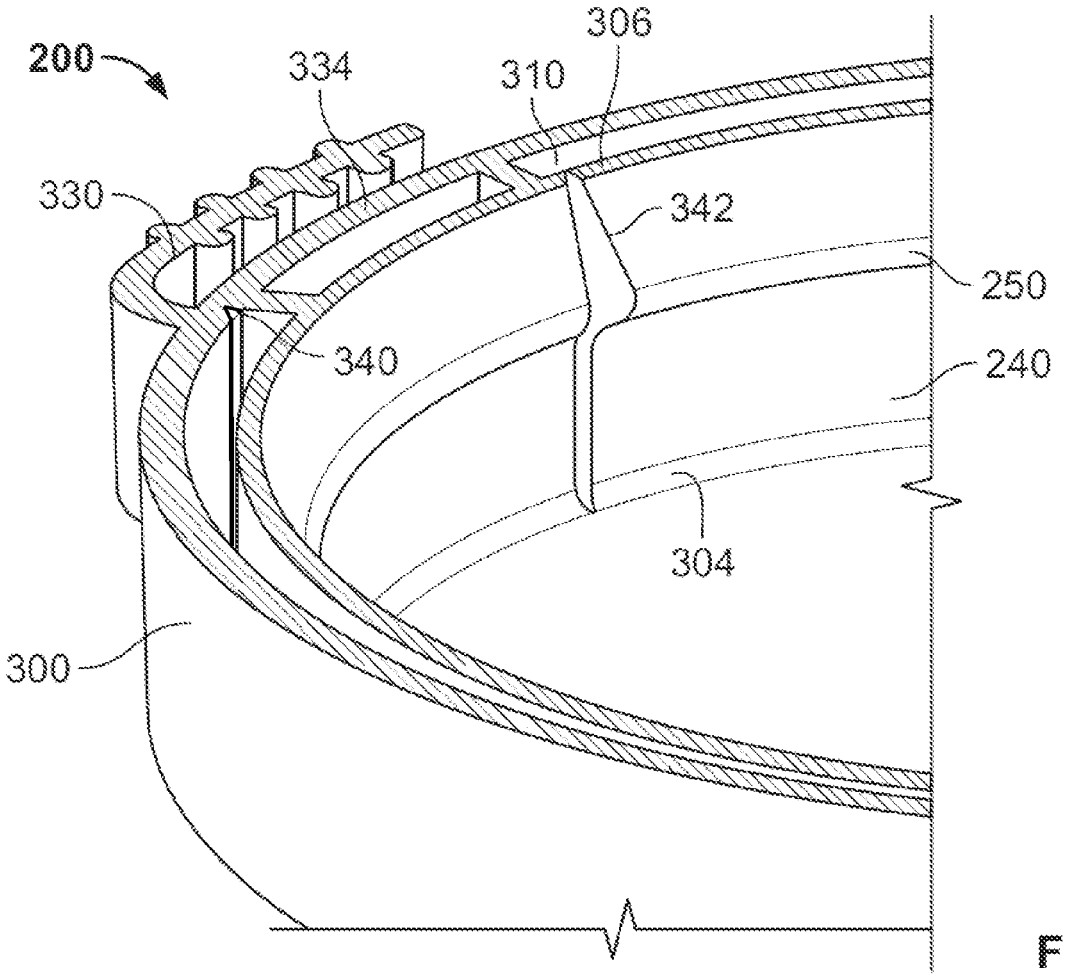
FIG. 5 is a bottom perspective view of the overcap and TE ring, highlighting the gripping handle, as indicated by callout 5 in FIG. 4.
Figure 6:
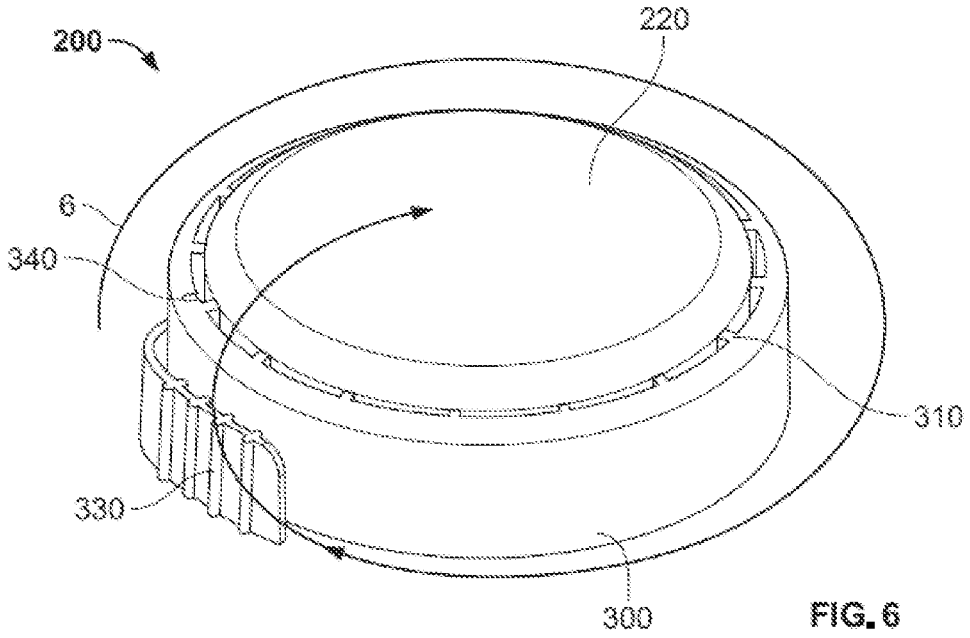
FIG. 6 is a top perspective view as in FIG. 1, but with arrow 6 indicating the general direction by which the TE ring can be removed.

With reference to FIGS. 1 through 6, the tamper evident closure system 100 includes overcap 200. A tamper evident ring or strip 300 is attached to the overcap 200 by frangible elements 310. The system 100 attaches to drum 10 and/or flange 20, while a bung cover 40 may be screwed into opening 30. Overcap 200 completely covers the cover 40 when system 100 is properly installed.

Overcap 200 is formed in cup shape, with a top panel 220 and cylindrical skirt 240 extending away from the panel 220 along an edge of its outer circumference. Top panel 220 may be elevated in comparison to ring 300, and include a bevel or shoulder along its top periphery. Preferably, panel 220 also presents a flat upper facing so as to allow for visual indicia (instructions, logos, other written information, etc.) to be printed or formed thereon.

Skirt 240 has an inner facing 242 with an engagement flange 250 toward the terminal edge 244 of skirt 240. Skirt 240 is sufficiently flexible to accommodate and enable snap-fitting the cap 200 onto and off of the drum 10. Also, skirt 240 extends downward in an axial direction away from panel 220 with sufficient clearance to concentrically enclose the cover 40 and engage any neck formation or similar feature of the flange 20 and/or drum 10. In some embodiments, the flange 20 and/or drum 10 form a common horizontal plane so that the skirt 240 and the ring 300 extend downward from the top panel 220 and terminate in that common plane.

In particular, a radially inward facing flange 250 includes a downwardly ramped surface 252 and tip 244. The ramp 252 slides over the lip or top facing of flange 20 selectively snap fit the overcap 200 onto the flange 20. Additionally or alternatively, if drum 10 includes a cooperating feature proximate to opening 30, it is possible for overcap 200 to snap-fit to these features as well. When the overcap 200 is removed, upper ramped surface 254 of flange 250 slides over the lip 20 and forces the skirt 240 to temporarily expand radially outward to allow cap 200 to be removed. Notably, the slope of upper ramp 254 will be steeper (relative to vertical/skirt 240) than the ramp 252 to ensure the cap 200 is secured to the drum 10.

Flange 250 may be disposed continuously along surface 242 or intermittently as a series of spaced apart elements. If provided intermittently, a sufficient number of flanges 250 should be provided to ensure the overcap 200 remains fitted to the drum 10/flange 20.

Skirt 240 also defines an outer facing 246. Outer facing substantially conforms to the profile of the inner facing 242, except that no flange or protrusions are provided on the outer facing. Instead, tamper evident ring 300 is affixed radially outward and/or above facing 246 via frangible elements 310, as described below. More generally, skirt 240 will have a substantially circular cylindrical shape (or other shape conforming to the profile of the flange 20 and/or opening 30) as defined by the facings 242, 246. Further, End 244 may be formed to maintain contact with the exterior facing of the drum 10 so as to enclose and/or seal the cap thereto.

TE ring 300 is disposed concentrically around at least a portion of the overcap 200. In one aspect, the ring 300 is frangibly connected to the outer surface 246 along the skirt 240 proximate to the junction of the skirt 240 and top panel 220. The frangible connection may be made by way of a plurality of bridge elements 310.

Bridge elements 310 may be integrally formed or molded so that the assembly 100 is provided as a single, unitary piece. Elements 310 have thinned section that is specifically designed to breakaway when subjected to the radial expansion and leveraging forces created as the flange 250 and, more specifically, the ramp 254 slides over the lip 20 and temporarily flexes the skirt 240 outward. In the same manner, a person should be able to engage and remove the ring 300 by grasping handle 320 and pulling upward and/or outward along arrow 6 without undue force or effort (i.e., the same amount of force exerted by the leveraging action of the ramp 254 sliding over the lip 20 as the overcap 200 is moved axially upward).

Grasping flange or handle 330 protrudes away from the outer surface 302 of the TE ring 300. Handle 330 may include knurling or ridges on one or both sides. Further, handle 330 attaches to ring 300 immediately adjacent to a first axial groove 340. Handle 330 may be held close to the ring 300 at its terminal end 332 by way of one or more frangible bridge connections 334. In use, the handle 330 would be pulled radially away from the surface 302 to break the connection 334. The full surface of handle 330 can then be grasped and pulled along arrow 6 so as to disengage the ring, with first axial groove 340 tearing to allow the ring 300 to pulled away as a strip.

As the ring 300 is pulled away from the overcap 200 according to line 6, the bridge elements 310 are broken. The presence of broken connections 310 (and/or the absence of ring 300 altogether) provide an indication that the overcap 200 may have been removed (with the further understanding that the removal of the overcap 200 could also enable the removal of cover 40 and the possible contamination of the contents of drum 10).

While the elements 310 are broken progressively and sequentially in circumferential manner, an optional second axial groove 342 may be provided proximate and parallel (or almost parallel) to the first groove 340. Second groove 342 is positioned underneath the handle 330 on ring 300 and/or skirt 240.

Groove 340 allows for the strip 300 to be separated in a vertical manner when force is applied via grasping handle 330 (also, preferably after connection 334 has been broken, so as allow the user to position handle 330 for maximum leverage). Thus, removal of strip 300 is initiated by applying upward or downward force to create a fissure in the ring along groove 340 (and, if present, along groove 342 after most/all of the bridges 310 have been broken), and the ring 300 may first begin separating at the top 304. However, it is possible to design the system 100 to begin separating from the bottom 306.

The grooves 340, 342 are preferably formed along vertical axis (i.e., substantially perpendicular to the plane defined by the top panel 240). However, the grooves may be formed along other angles, so long as they run substantially from the top 304 to the bottom 306 edge of the ring 300 itself. Similarly, the grooves 340, 342 need not be parallel and, instead, may diverge so that they are spaced further apart along the bottom edge 306 (in comparison to their positioning at the top edge 304). In lieu of grooves, perforations or other deliberately arranged thinned sections could be employed, so long as the ring is separated from top-to-bottom proximate to the attachment point of handle 330 to ring 300, thereby enabling the radial, circumferential breaking of elements 310 and removal of ring 300.

Grooves 340, 342 ensures that the ring 300 detaches as an elongated strip, rather than as a still-intact circular ring. Removal as a strip should minimize the environmental impact by eliminating a potential choking hazard to large marine and other wildlife. Also, while two grooves 340, 342 are illustrated, it is possible to rely on a single groove immediately adjacent to the handle 330 connection point, so long as the positioning of these elements still allows the ring 300 to be torn away and removed as a single, unitary strip.

As noted above, one advantage of system 100 is that, as an integrally formed piece, it is easily snap-fitted onto virtually any drum fitting employing a bung cover. The system 100 is expected to have particular utility in standard sized ¾ inch and 2 inch covers, such as the Rieke TiteGrip™ for steel drum closures. Notably, the closure system should have a lip 20 with sufficient radial clearance thereunder to accommodate the flange 250. The progressively longer slope of ramp 252 (in comparison to the shorter, steeper slope of ramp 254) ensures that the force required to initially snap-fit system 100 in place is applied more gradually (in comparison to the removal force required to overcome ramp 254) so as to avoid premature breakage of connection elements 310. In both installation and use, system 100 does not require any special tools and, instead, can be installed by hand at any point during the drum's use.

Overcap 200 provides a convenient surface upon which labeling or printed indicia can be provided to distinguish the contents of otherwise mass-produced and identical drums and bung covers. In particular, top panel 240 should present with a smooth surface that can receive labels, imprinted information, or even be molded to convey instructions, labeling, or other indicia.

In view of the foregoing, overcaps according to the invention may include any combination of the following features:

- a cap having a top panel, an annular skirt forming a sidewall extending downward from the top panel, and at least one engagement flange protruding radially inward from the sidewall;
- a removable tamper evident member attached to a periphery of the cap by way of a plurality of frangible bridge element, the member including a grasping handle extending radially outward from a cylindrical strip having a first groove disposed along a vertically-oriented axis;
- wherein the tamper evident member is removed from the cap by providing vertical force via the grasping handle to create a break in the cylindrical strip along the first groove and wherein continued rotational force, also provide via the grasping handle, cause the frangible bridge elements to sequentially break, thereby separating the tamper evident member from the overcap and wherein the overcap remains secured to the drum during removal of the tamper evident member;
- wherein a connection element secures the grasping handle to an outer facing of the cylindrical strip;
- wherein the connection element is detached so as to allow greater range of motion for the grasping handle prior to removal of the tamper evident member from the cap;
- wherein a second groove is formed in the strip;
- wherein the second groove is formed along a substantially parallel axis relative to the first groove;
- wherein the engagement flange continues along an unbroken circumference of an inner facing of the sidewall;
- wherein a plurality of discrete engagement flanges are positioned along a circumference of an inner facing of the sidewall;
- wherein the engagement flange includes an upper ramped section and a lower ramped section oriented at a different angle in comparison to the upper ramped section;
- wherein the upper ramped section is sloped so as to snap-fit to a formation on the drum;
- wherein the upper ramped section forms an obtuse angle relative to a vertical axis of the sidewall and the lower ramped section forms an acute angle relative to the vertical axis;
- wherein the tamper evident member is held to an outer facing of the sidewall;
- wherein the tamper evident member is held to a peripheral edge of the top panel'
- wherein the tamper evident member and the sidewall extend downward from the top panel to terminate in a common horizontal plane; and
- wherein the cap encloses an internal volume that is sufficient to receive and cover a drum flange and a bung cover.

A container system is also contemplated. This system includes a drum or other vessel having an aperture, a flange fitted within the aperture, a removable bung cover to selectively seal the aperture, and an overcap according to the various embodiments identified in the preceding paragraph. The overcap is removably snap-fitted to the flange so as to encase and cover the bung cover.

All components should be made of materials having sufficient flexibility and structural integrity, as well as a chemically inert nature. The materials should also be selected for workability, cost, and weight. In addition to the materials specifically noted above, common polymers amenable to injection molding, extrusion, or other common forming processes should have particular utility, although metals, alloys, and other composites may be used in place of or in addition to more conventional materials. Various grades of low density polyethylene are expected to have particular utility in view of the design goals and requirements noted above.

Although the present embodiments have been illustrated in the accompanying drawings and described in the foregoing detailed description, it is to be understood that the invention is not to be limited to just the embodiments disclosed, and numerous rearrangements, modifications and substitutions are also contemplated. The exemplary embodiment has been described with reference to the preferred embodiments, but further modifications and alterations encompass the preceding detailed description. These modifications and alterations also fall within the scope of the appended claims or the equivalents thereof.

What is claimed is:

1. A tamper-evident overcap for snap-fitting to a drum, the overcap comprising:

a cap having a substantially flat top panel configured to conceal a bung cover formed in a drum, an annular skirt forming a sidewall extending downward from the top panel, and at least one engagement flange protruding radially inward from the sidewall; and a removable tamper evident member attached to an outer periphery of the cap by way of a plurality of frangible bridge elements, the removable tamper evident member comprising a cylindrical strip, concentrically disposed around an outer facing of the sidewall with a first groove disposed along a vertically-oriented axis of the cylindrical strip, and a grasping handle extending radially outward from an outer facing of the cylindrical strip;

wherein the removable tamper evident member is removed from the cap by providing vertical force via the grasping handle to create a break in the cylindrical strip along the first groove;

wherein continued rotational force, also provide via the grasping handle, causes the frangible bridge elements to sequentially break, thereby separating the removable tamper evident member from the overcap; and wherein the engagement flange continues to secure the overcap after the tamper evident member is removed.

2. The overcap of claim 1 wherein a connection element secures the grasping handle to an outer facing of the cylindrical strip.

3. The overcap of claim 2 wherein the connection element is detached so as to allow greater range of motion for the grasping handle prior to removal of the tamper evident member from the cap.

4. The overcap of claim 1 wherein a second groove is formed in the strip.

5. The overcap of claim 4 wherein the second groove is formed along a substantially parallel axis relative to the first groove.

6. The overcap of claim 1 wherein the engagement flange continues along an unbroken circumference of an inner facing of the sidewall.

7. The overcap of claim 1 wherein a plurality of discrete engagement flanges are positioned along a circumference of an inner facing of the sidewall.

8. The overcap of claim 1 wherein the engagement flange includes an upper ramped section and a lower ramped section oriented at a different angle in comparison to the upper ramped section.

9. The overcap of claim 8 wherein the upper ramped section is sloped so as to snap-fit to a formation on the drum.

10. The overcap of claim 8 wherein the upper ramped section forms an obtuse angle relative to a vertical axis of the sidewall and the lower ramped section forms an acute angle relative to the vertical axis.

11. The overcap of claim 1 wherein the tamper evident member is held to an outer facing of the sidewall.

12. The overcap of claim 1 wherein the tamper evident member is held to a peripheral edge of the top panel.

13. The overcap of claim 1 wherein the tamper evident member and the sidewall extend downward from the top panel to terminate in a common horizontal plane.

14. The overcap of claim 1 wherein the cap encloses an internal volume that is sufficient to receive and cover a drum flange and a bung cover.

* * * * *